US005172656A

United States Patent [19]

Wright

[11] Patent Number: 5,172,656

[45] Date of Patent: Dec. 22, 1992

[54] AUXILIARY SYSTEM FOR HEATING/COOLING INTERNAL COMBUSTION ENGINE

[76] Inventor: Marvin L. Wright, P.O. Box 36, Mill Shoals, Ill. 62862

[21] Appl. No.: 796,590

[22] Filed: Nov. 22, 1991

[51] Int. Cl.[5] ..... F01P 9/00

[52] U.S. Cl. ..... 123/41.01; 123/41.15

[58] Field of Search ..... 123/41.01, 41.15, 142.5 R

[56] References Cited

U.S. PATENT DOCUMENTS

| | | | |
|---|---|---|---|
| 1,111,526 | 9/1914 | Coppock | 180/68.1 |
| 1,701,999 | 2/1929 | Gardner et al. | 237/12.3 A |
| 2,319,002 | 5/1943 | Kramer | 180/54 |
| 2,514,253 | 7/1950 | Partin | 123/170 |
| 2,715,394 | 8/1955 | Humpola et al. | 123/41 |
| 2,867,996 | 1/1959 | Bullard | 62/243 |
| 4,286,551 | 9/1981 | Blitz | 123/41.31 |
| 4,335,849 | 6/1982 | van Bashuysen | 237/12.3 |
| 4,591,691 | 5/1986 | Badali | 219/202 |
| 4,977,862 | 12/1990 | Aihara et al. | 123/41.15 |
| 4,993,377 | 2/1991 | Itakura | 123/142.1 |

*Primary Examiner*—Noah P. Kamen

*Attorney, Agent, or Firm*—Grace J. Fishel

[57] ABSTRACT

A system for heating and cooling an internal combustion engine having an air/duct system, a radiator and a liquid coolant and refrigerant. The system includes a device for diverting tempered air from the air/duct system into a conduit for transport to a device which pulls the tempered air from the conduit and delivers it into the fins of the radiator for heating or cooling the engine.

8 Claims, 2 Drawing Sheets

AUXILIARY SYSTEM FOR HEATING/COOLING INTERNAL COMBUSTION ENGINE

The present invention relates to an auxiliary system for heating and cooling a liquid cooled internal combustion engine.

BACKGROUND OF THE INVENTION

The temperature of a liquid cooled internal combustion engine can be modulated by a liquid coolant circulated through the engine and a radiator. There are sophisticated built-in systems for controlling the temperature of the liquid coolant by controlling the rate at which it circulates. Under extreme conditions, however, the liquid coolant may still be too cold or get too hot. If the coolant is too cold, the engine may run rough or stall and if the coolant is too hot, the engine may overheat and be damaged. Overheating can occur when the motor vehicle is driven hard or in heavy traffic necessitating frequent stops and starts. If the vehicle has air conditioning, the air conditioner is frequently driven by the engine and this additional load causes further overheating. Overcooling can occur under extremely cold driving conditions.

A liquid cooled engine can be cooled by running the heater in the passenger compartment. This works because the heat given off by the heater comes from the coolant, a portion of which is routed through a heater core for warming the passenger compartment. This technique, while effective at reducing the temperature of the circulating liquid coolant in hot weather, is at the expense of the passengers' comfort. Other than for running the heater, there is no simple way for the operator of the vehicle to affect the temperature of the liquid coolant.

There are various add-on systems for heating or cooling a liquid cooled engine. For example, there are electrical heaters for heating the coolant and evaporators for cooling the radiator. There is a system for directing a side stream of air from an air conditioner onto the radiator and another system for directing a stream of heated or cooled air from an auxiliary air tempering unit onto the radiator. None of these systems, however, make use of conventional heating/cooling systems normally found on motor vehicles as the basis for an auxiliary system for heating and cooling the liquid coolant.

OBJECTS AND SUMMARY OF THE INVENTION

It is an important object of the present invention to provide an auxiliary system for heating and cooling a liquid cooled internal combustion engine making use of conventional heating/cooling systems normally found on motor vehicles as the basis for the auxiliary system for heating and cooling the liquid coolant.

Other objects and features of the invention will be in part apparent and in part pointed out, the scope of the invention being indicated by the subjoined claims.

In accordance with the invention, a system for heating and cooling an internal combustion engine operates with an engine of the kind having a liquid coolant and a liquid refrigerant. The liquid coolant is circulated between the engine where it picks up heat and a radiator where it surrenders its heat as it flows through the radiator with a portion of the liquid coolant routed to a heater core for warming the passenger compartment. The liquid refrigerant is circulated by a compressor driven by the engine between a condenser located in front of the radiator and an evaporator located with the heater core in a heater/air conditioner case/duct.

The system for heating and cooling an internal combustion engine comprises a conduit having first and second ends. The first end is flowably connected to means for diverting air which has been tempered in the case/duct into the conduit. The second end is flowably connected to means for exhausting the tempered air from the conduit and delivering it towards the radiator.

The invention as summarized above comprises the constructions hereinafter described, the scope of the invention being indicated by the subjoined claims.

BRIEF DESCRIPTION OF THE DRAWINGS

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 2:
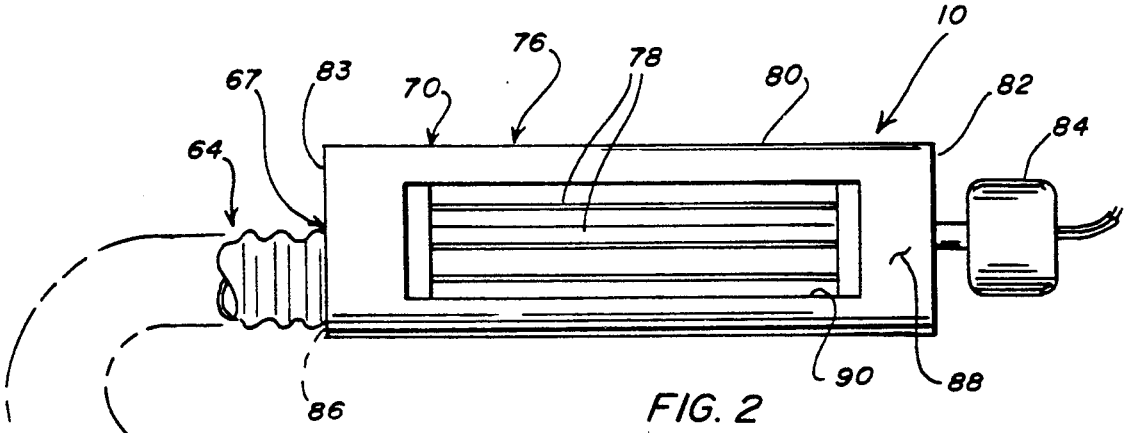
FIG. 2 is a side elevational view of the system for heating and cooling an internal combustion engine.

Referring to the drawings more particularly by reference character and with particular reference to FIG. 2, reference numeral 10 refers to a system in accordance with the present invention for heating and cooling an internal combustion engine.

Engine Details

Figure 1:
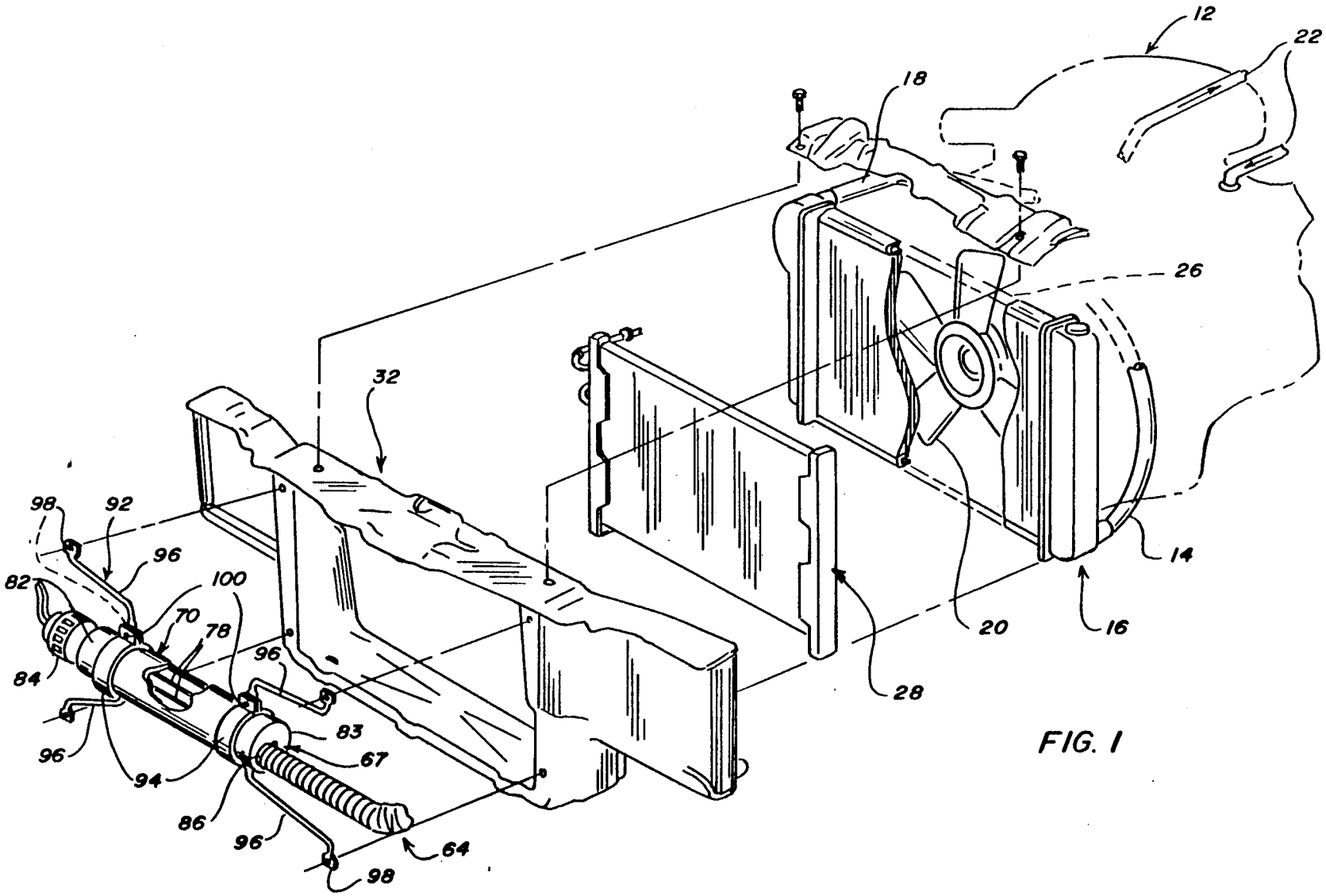
FIG. 1 is an exploded perspective view of a system for heating and cooling an internal combustion engine in accordance with the present invention shown mounted on a radiator frame in front of a condenser and a radiator.

As shown in FIG. 1, an internal combustion engine 12 is of the kind having a liquid cooling system. A liquid coolant is drawn via a hose 14 from the bottom of a radiator 16 through passages in the engine block, where it picks up heat. The heated coolant exits engine 12 via an upper hose 18 and enters the top of the radiator, where it surrenders its heat as it flows through rows of tubes connected to metal fins. A fan 20 on engine 12 helps dissipate the coolant's heat by pulling air through the radiator fins. Some of the coolant warmed by the engine is routed through a heater supply hose 22 to a heater core 24 for warming the passenger compartment.

Figure 3:
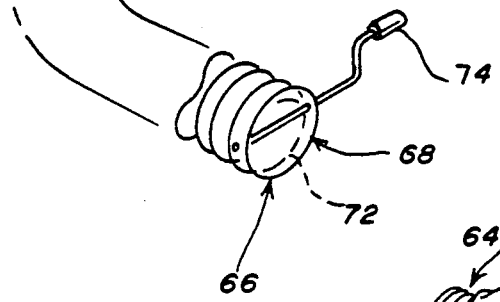
FIG. 3 is a perspective view of a typical case/duct with the system for heating and cooling an internal combustion engine attached; and, FIG. 4 is a schematic of the case/duct and attached system for heating and cooling shown in FIG. 3.
Figure 3:
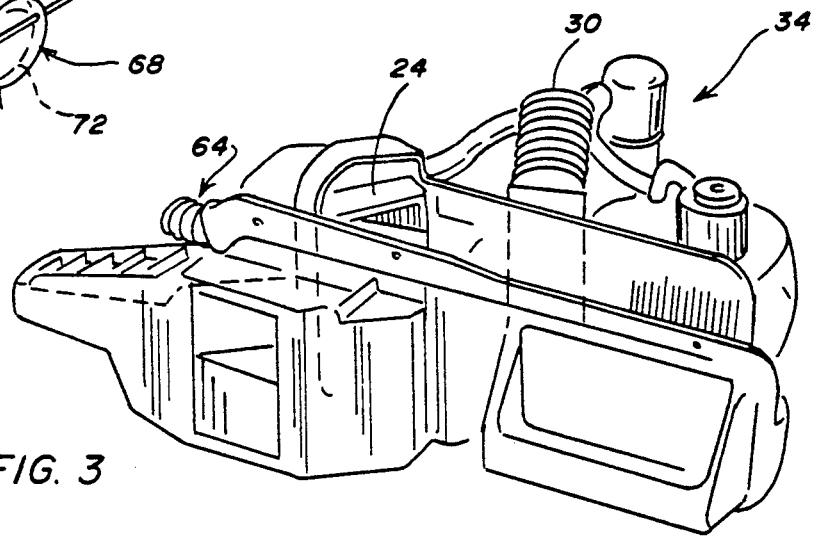
Figure 4:
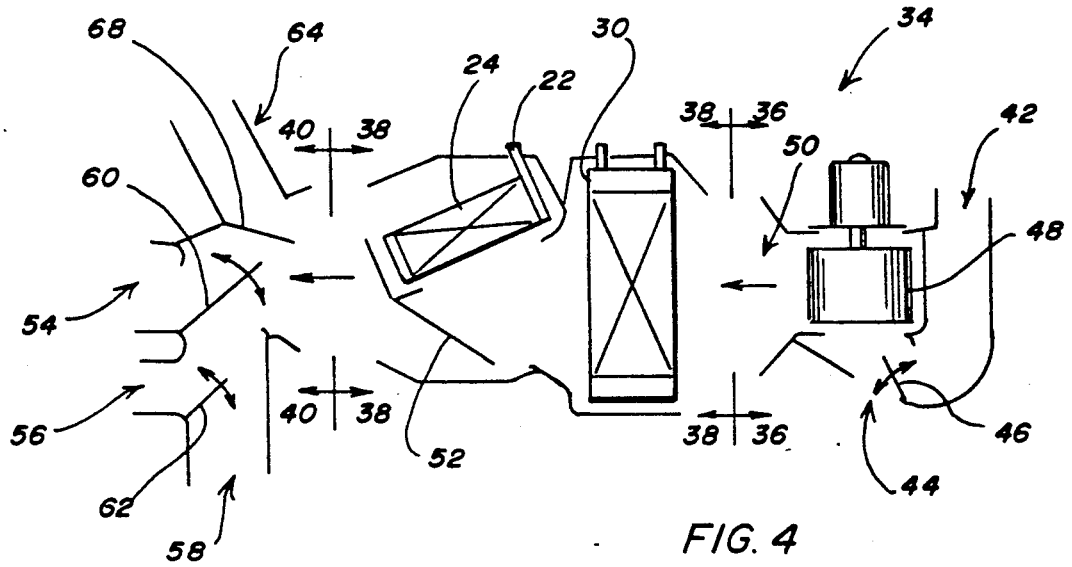

Engine 12 further has a liquid refrigerant system. A liquid refrigerant is circulated by a compressor 26 driven by engine 12 between a condenser 28 located in front of radiator 16 and an evaporator 30. Condenser 28 and radiator 16 are mounted in a radiator frame 32. Evaporator 30 is located with heater core 24 in a heater/air conditioner case/duct system 34, a typical one of which is illustrated in FIGS. 3 and 4.

The liquid refrigerant is metered into evaporator 30 and the pressure of the refrigerant lowered. As a result, the refrigerant begins to boil and changes into a vapor. During this process, the refrigerant picks up heat from warm air passing through the fins of evaporator 30. Compressor 26 pumps the heat-laden refrigerant vapor from evaporator 30, compresses it and sends it under high pressure to condenser 28. Since the vapor is much hotter than the surrounding air, it gives up heat to the outside air flowing though the condenser fins and changes to a liquid. The condensed liquid is then pumped back to evaporator 30 where the process repeats.

The purpose of case/duct system 34 is two fold: It is used to house heater core 24 and evaporator 30 and to direct the selected supply of air through these components. Case/duct system 34 is divided into three sections. For illustration, these sections are an air intake section 36, a heater core and evaporator plenum section 38 and an air distribution section 40. The air intake section 36 consists of a fresh (outside) air inlet 42, a recirculate (inside) air inlet 44, a fresh-recirculate air door 46, a blower 48 with motor, and an air outlet 50. Fresh air inlet 42 provides the system with a fresh outside air supply; recirculate air inlet 44 provides recirculated in-car air supply. The position of fresh-recirculate air door 46 depends on the system mode.

Plenum section 38 is the center section of case/duct system 34. It consists of heater core 24, air conditioner evaporator 30 and a blend door 52. Air flow is from right to left in the illustration. Blend door 52 provides full-range control of airflow either through or bypassing heater core 24. All air passes through evaporator 30. It is in this section that full-range temperature conditions are provided for in-car comfort.

Hot engine coolant flows through heater core 24. Cool outside fresh air is heated as it passes through heater core 24. When the air conditioner is not operational, evaporator 30 has no effect on the temperature of the air passing through. The desired temperature level is achieved by the position of blend door 52. This allows a percentage of the cool outside air to bypass the heater core to temper the heated air. The heated air and cooled air are then blended in the plenum to provide the desired temperature level before passing to air distribution section 40.

In maximum cooling, recirculated air passes through air conditioner evaporator 30 and is then directed back into the car. In other than MAX A/C, fresh outside air passes through evaporator 30 and is cooled before delivery into the car. The desired temperature level is achieved by the position of blend door 52. Blend door 52 allows a percentage of cooled air to pass through heater core 24 to be reheated. The cooled air passing though evaporator 30 and the reheated air passing though heater core 24 are blended in the plenum to provide the desired temperature level. This tempered air is then directed to air distribution section 40.

Air distribution section 40 directs tempered air to be discharged to floor outlets 54, defrost outlets 56 or dash panel outlets 58. There are two mode (blend) doors in air distribution section 40, i. e., HI/LO door 60 and DEF/AC door 62.

The case/duct system shown in FIGS. 3 and 4 represents no particular manufacturer's design and should be understood in the context that for use in the present invention, it is sufficient that there be a source of tempered air. As will be understood by those skilled in the art, there are many case/duct system designs. For example, in independent case/duct systems (used on compact and small cars), blower 48 may be upstream or downstream of heater core 24. In split/case systems (used on larger cars), blower 48 may be integral and upstream or independent. Some blend doors are vacuum operated, whereas others are Bowden cable operated. Some doors are infinitely variable and so forth.

System Details

System 10 for heating and cooling engine 12 includes a conduit 64 having first and second ends 66, 67, respectively. The first end is flowably connected to means 68 for diverting tempered air (i. e., air which is tempered in case/duct 34) into conduit 64. The second end is flowably connected to means 70 for exhausting the tempered air from the conduit and delivering it towards radiator 16.

Means 68 as shown in FIGS. 2 and 4 comprises a door 72 which can be opened and closed manually with a handle 74. The door illustrated in FIG. 2 is of the stove damper type but door 72 may formed like the mode and blend doors in case/duct system 34 and so forth. It will be understood that door 72 may also be operated mechanically with a Bowden cable or the like, pneumatically or electrically and be thermostatically controlled automatically. Door 72 is positioned such that a portion of the air which is tempered in plenum section 38 is diverted into conduit 64. As such door 72 may be located in plenum section 38 or, as shown in FIG. 4, in air distribution section 40 or in one of outlets 54, 56 or 58. Door 72 may have a selected number of positions besides full open and closed or it can be infinitely variable as desired.

Means 70 as shown in FIGS. 1 and 2 comprises a fan 76 specifically illustrated as a paddle wheel fan. In means 70, a paddle wheel 78 is journaled in a generally cylindrical case 80 between first and second ends 82, 83, respectively. A motor 84 is provided at the first end for turning the paddle wheel in a direction such that tempered air is directed upwardly into radiator 16. An aperture 86 is provided at the second end of case 80 for attachment of means 70 to conduit 64. Case 80 has a sidewall 88 with a cutout 90. Means 92 for mounting paddle wheel fan 76 are provided for positioning the paddle wheel fan in front of condenser 28 with cutout 90 directed towards radiator 16 in such manner that the fan delivers tempered air from conduit 64 in a direction generally parallel to the airstream through the radiator.

With continuing reference to FIG. 1, means 92 for mounting paddle wheel fan 76 comprise encircling clamps 94, a pair of which is provided at opposite ends of case 82, 83 for attachment to braces 96. Both ends of clamps 94 terminate with an eye 98 as do braces 96. Eyes 98 are used to connect clamps 94 with braces 96 and braces 96 to radiator frame 32 with bolts 100.

In use, system 10 can be used for heating and cooling engine 12 depending on whether air tempered in case/duct system 34 is heated or cooled. To minimize the impact on the passengers' comfort, it is preferred that no more than 40 to 50% of the tempered air from case/duct system 34 be diverted through means 68 into conduit 64.

When means 68 is in position to divert tempered air into conduit 64, means 70 should also be in operation to exhaust the conditioned air from conduit 64 and deliver it towards radiator 16. For best effect, it is preferred that fan 76 be mounted about half way between the top and the bottom of radiator 16 and that it be about two-thirds the length of the radiator so that it does not materially interfere with air flow through the condenser and the radiator.

In hot weather, system 10 can be used to cool engine 12 and in cold weather, it can be used to heat the engine.

It is particularly useful for cooling in vehicles with large engines such as police cars and ambulances. These vehicles are typically run hard and cannot be shut down when they arrive at the scene of an accident or the like. System 10 can be used to keep big engines from overheating and being damaged but it is also useful on small engines which can overheat too.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A system for heating and cooling an internal combustion engine wherein a liquid coolant is circulated between the engine where it picks up heat and a radiator where it surrenders its heat as it flows through the radiator with a portion of the liquid coolant routed to a heater core for warming the passenger compartment and wherein a liquid refrigerant is circulated by a compressor driven by the engine between a condenser located in front of the radiator and an evaporator located with the heater core in a heater/air conditioner case/-duct forming means for tempering air, said system comprising a conduit having first and second ends, said first end flowably connected to means for diverting air which is tempered in the case/duct into the conduit and said second end flowably connected to means for exhausting tempered air from the conduit and delivering it towards the radiator.

2. The system of claim 1 wherein the means for diverting air comprises a door downstream of the heater core and evaporator.

3. The system of claim 2 wherein the means for exhausting and delivering air comprises a fan.

4. The system of claim 2 wherein the means for exhausting and delivering air comprises a paddle wheel fan in a generally cylindrical casing having first and second ends and a sidewall with a cutout, said second end of the casing having an aperture, said second end of the conduit flowably connected to the aperture in the second end of the casing, said fan mounted in front of the condenser with the cutout directed towards the radiator in such manner that the fan delivers the tempered air in a direction generally parallel to the airstream through the radiator.

5. A system for heating and cooling an internal combustion engine wherein a liquid coolant is circulated between the engine where it picks up heat and a radiator where it surrenders its heat as it flows through the radiator with a portion of the liquid coolant routed to a heater core for warming the passenger compartment and wherein a liquid refrigerant is circulated by a compressor driven by the engine between a condenser located in front of the radiator and an evaporator located with the heater core in a heater/air conditioner case/-duct forming means for tempering air, said system comprising a conduit having first and second ends, said first end flowably connected to a door downstream of the heater core and evaporator for diverting air which is tempered in the case/duct into the conduit and said second end flowably connected to a fan for exhausting tempered air from the conduit and delivering it towards the radiator.

6. The system of claim 5 wherein the condenser and the radiator are mounted in a radiator frame and further comprising means for mounting the fan on the radiator frame in front of the condenser and radiator.

7. The system of claim 6 wherein the fan comprises a paddle wheel in a generally cylindrical casing having a sidewall with a cutout and first and second ends between which the paddle wheel fan is journaled, said first end of the casing mounting a motor for turning the paddle wheel and said second end of the casing having an aperture, said second end of the conduit flowably connected to the aperture in the second end of the casing, said paddle wheel turned by the motor and the cutout directed towards the radiator in such manner that the fan delivers the tempered air in a direction generally parallel to the airstream through the radiator.

8. The system of claim 7 wherein the condenser and the radiator are mounted in a radiator frame and further comprising means for mounting the fan on the radiator frame in front of the condenser and radiator about half way between the top and the bottom of the radiator.

* * * * *